US007177149B2

(12) United States Patent
Lin

(10) Patent No.: US 7,177,149 B2
(45) Date of Patent: Feb. 13, 2007

(54) HEAT DISSIPATING FAN ASSEMBLY WITH AN AC-TO-DC CONVERTER

(76) Inventor: Hao-Cheng Lin, No. 28, Hsi-Ning S. Rd., Wan-Hwa Dist., Taipei City (TW)

( * ) Notice: Subject to any disclaimer, the term of this patent is extended or adjusted under 35 U.S.C. 154(b) by 266 days.

(21) Appl. No.: 10/850,196

(22) Filed: May 19, 2004

(65) Prior Publication Data

US 2005/0259394 A1 Nov. 24, 2005

(51) Int. Cl.
*H05K 7/20* (2006.01)
*F24F 11/02* (2006.01)

(52) U.S. Cl. ..... 361/695; 165/244

(58) Field of Classification Search ..... 361/695, 361/694; 454/184–186; 165/244
See application file for complete search history.

(56) References Cited

U.S. PATENT DOCUMENTS 5,680,294 A * 10/1997 Stora et al. ..... 361/695
6,075,698 A * 6/2000 Hogan et al. ..... 361/695
6,316,718 B1 * 11/2001 Lin ..... 174/17 VA
6,406,257 B1 * 6/2002 Houdek ..... 415/213.1
6,597,972 B2 * 7/2003 Emberty et al. ..... 700/304
6,947,281 B2 * 9/2005 Wrycraft et al. ..... 361/695
6,999,313 B2 * 2/2006 Shih ..... 361/695
7,033,206 B2 * 4/2006 Chang et al. ..... 439/485

* cited by examiner

*Primary Examiner*—Anatoly Vortman
(74) *Attorney, Agent, or Firm*—Christensen O'Connor Johnson Kindness PLLC

(57) ABSTRACT

A heat dissipating fan assembly includes a fan housing, a fan unit, a converter, and a connecting unit. The fan unit includes a DC motor mounted within the fan housing, and a plurality of blades extending outwardly from and driven by the motor. The converter includes a casing mounted on the fan housing, an AC-to-DC converter circuit unit provided within the casing, and an AC input and a DC output connected to the circuit unit. The connecting unit has a first connector coupled to the DC motor, and a second connector coupled to the DC output and matable with the first connector.

5 Claims, 5 Drawing Sheets

HEAT DISSIPATING FAN ASSEMBLY WITH AN AC-TO-DC CONVERTER

BACKGROUND OF THE INVENTION

1. Field of the Invention

The invention relates to a fan assembly, more particularly to a heat dissipating fan assembly that can be powered by either a DC power source or an AC power source.

2. Description of the Related Art

A conventional heat dissipating fan is powered using an alternating current (AC) or a direct current (DC) power source. In the AC-powered fan, changes in the magnetic field of an induction coil as a result of a sinusoidal voltage results in rotation of a fan blade unit that is provided with a magnetic element, thereby producing air current to dissipate heat.

The DC-powered fan functions substantially similar to the AC-powered fan. However, in the DC-powered fan, a direct voltage is applied to actuate a Hall element in the DC-powered fan so as to produce the changes in the magnetic field of the induction coil.

Under the circumstances where the dimension and the rotational speed of the AC- and DC-powered fans are the same, the structure of the induction coil in the AC-powered fan is usually larger than that in the DC-powered fan, and the fan blades are made correspondingly smaller, so that the wind pressure and the wind flow of the AC-powered fan are inferior to those of the DC-powered fan. Furthermore, since the induction coil in the AC-powered fan easily produces high temperatures, an aluminum frame is usually used to assist in dissipating the heat of the fan blade unit. However, this only makes the weight of the AC-powered fan heavier. Moreover, since the AC-powered fan produces a stronger electromagnetic wave interference during rotation, it is not suitable for use in high precision instruments.

As compared to the AC-powered fan, the structure of the induction coil in the DC-powered fan is smaller, and the fan blades are made correspondingly larger. As such, the wind pressure and the wind flow of the DC-powered fan are superior. Furthermore, the electromagnetic wave interference and the self-produced heat of the DC-powered fan are smaller such that the DC-powered fan has wider applications. The rotational speed of the DC-powered fan is also easy to control. Moreover, an outer casing of the DC-powered fan can be made of a transparent material, so that when used with a light emitting diode, the appearance of the heat dissipating fan can be enhanced.

However, the conventional DC-powered fan cannot be used where a direct current power source is not available. To resolve this problem, a DC power supply or an AC-to-DC converter has to be separately purchased and installed, which results in added costs.

SUMMARY OF THE INVENTION

Therefore, the object of the present invention is to provide a heat dissipating fan assembly that can be powered by either a DC power source or an AC power source.

According to this invention, a heat dissipating fan assembly comprises a fan housing, a fan unit, a converter, and a connecting unit. The fan unit includes a DC motor mounted within the fan housing, and a plurality of blades extending outwardly from and driven by the motor. The converter includes a casing mounted on the fan housing, an AC-to-DC converter circuit unit provided within the casing, and an AC input and a DC output connected to the circuit unit. The connecting unit has a first connector coupled to the DC motor, and a second connector coupled to the DC output and matable with the first connector.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
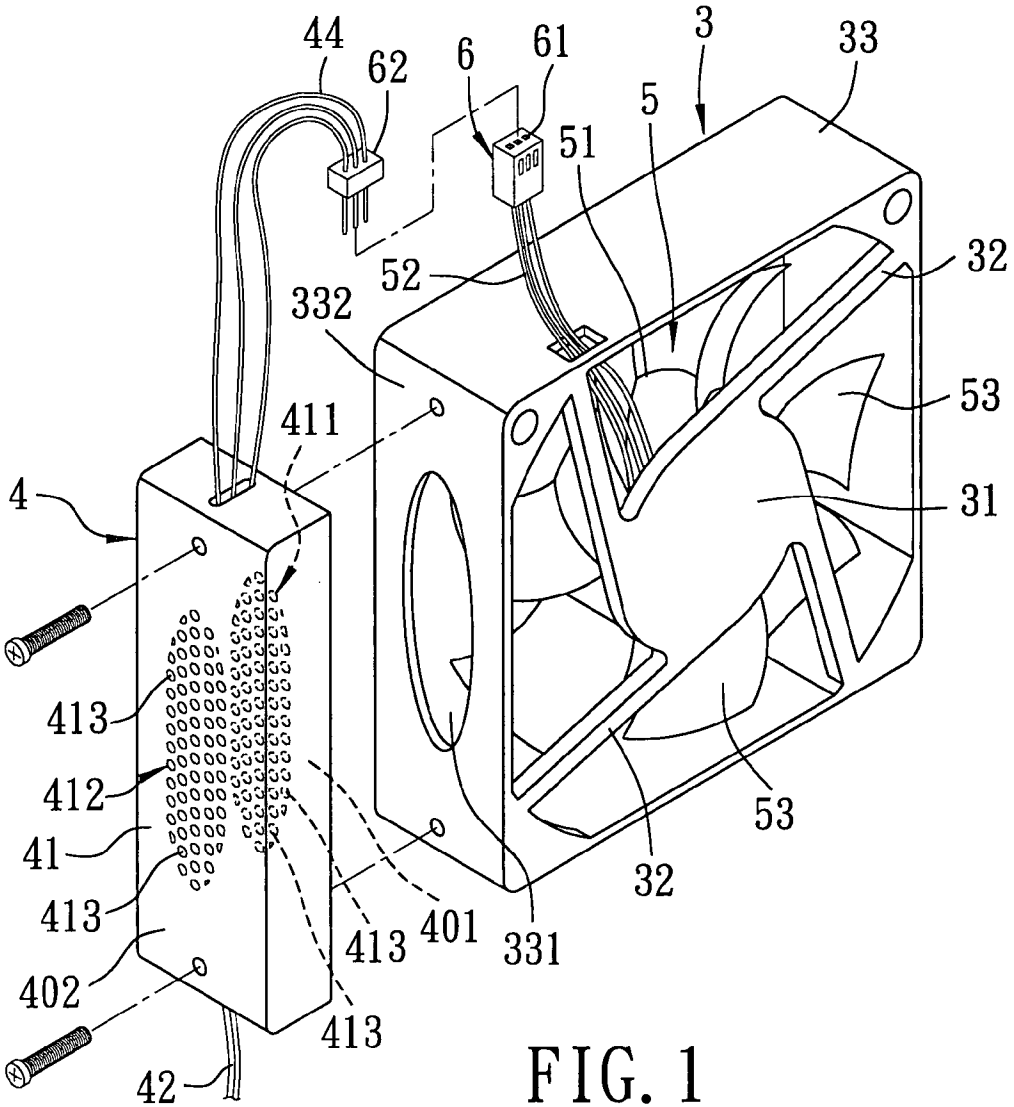
FIG. 1 is a partly exploded perspective view of the first preferred embodiment of a heat dissipating fan assembly according to the present invention.

Before the present invention is described in greater detail, it should be noted that like elements are denoted by the same reference numerals throughout the disclosure.

Figure 2:
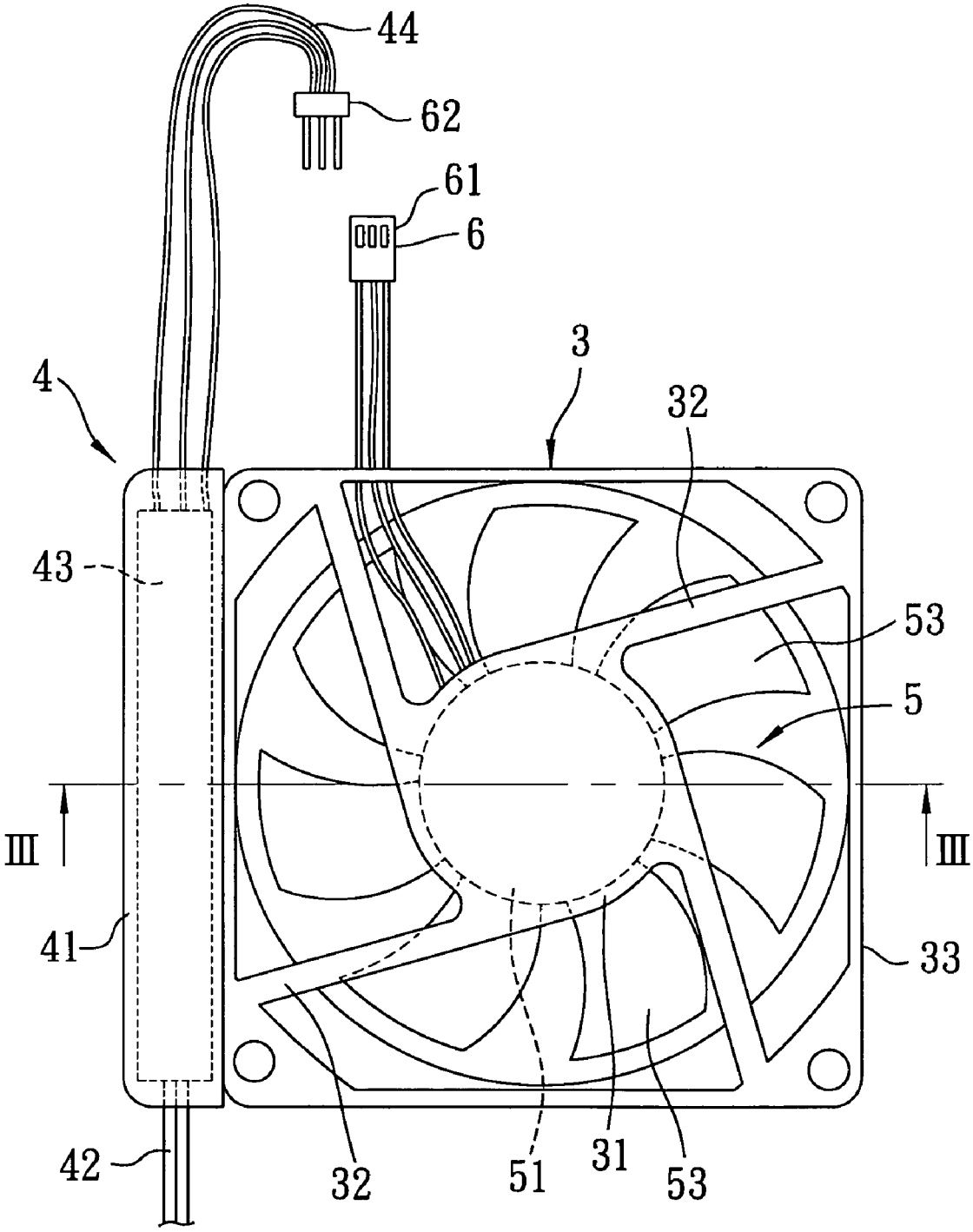
FIG. 2 is a schematic view of the first preferred embodiment in an assembled state.
Figure 3:
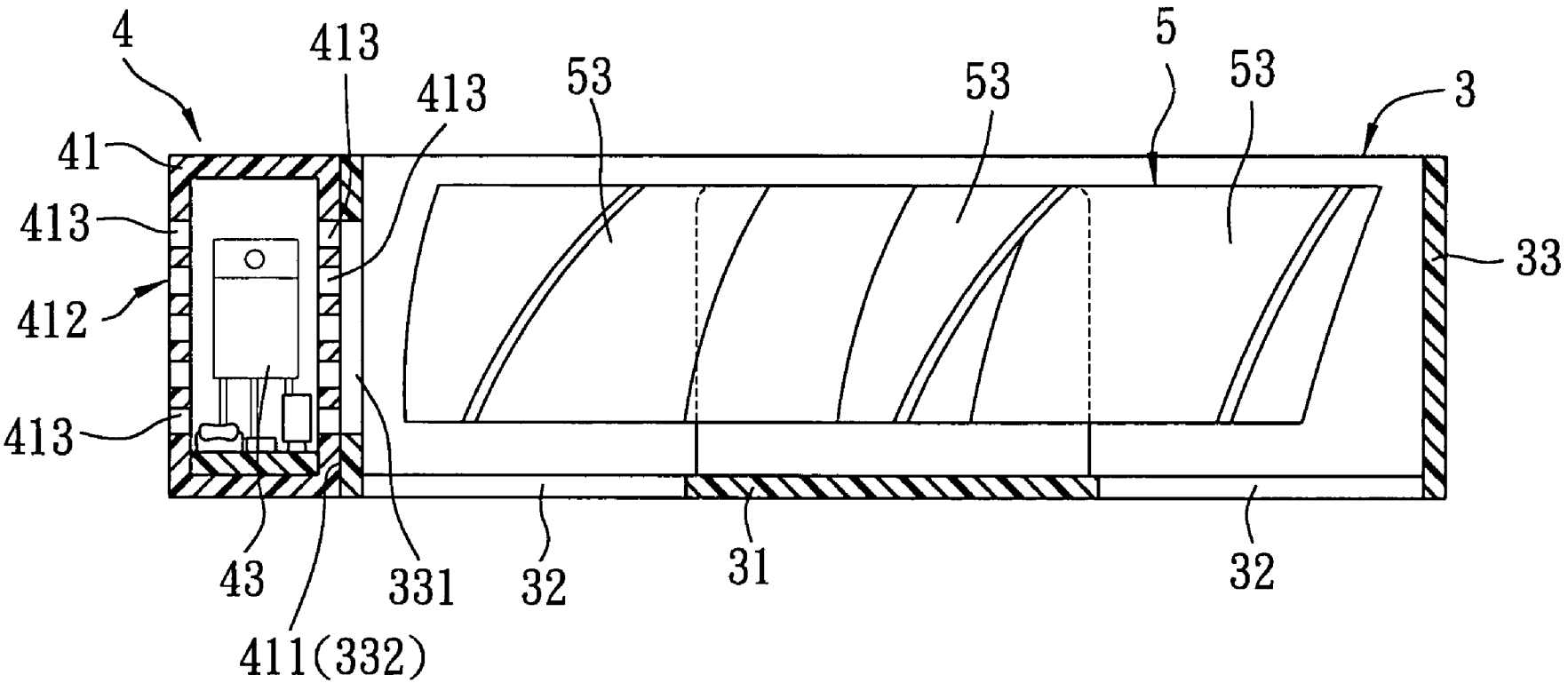
FIG. 3 is a partly sectional view of the first preferred embodiment, taken along line III—III of FIG. 2.

Referring to FIGS. 1 to 3, the first preferred embodiment of a heat dissipating fan assembly according to the present invention is shown to comprise a fan housing 3, a converter 4, a fan unit 5, and a connecting unit 6.

The fan housing 3 includes a substantially rounded base plate 31, a plurality of spaced-apart branching brackets 32 extending outwardly from the base plate 31, and a surrounding wall 33 extending around and connected to the branching brackets 32.

The converter 4 includes a hollow rectangular casing 41 screwed to the surrounding wall 33, an AC-to-DC converter circuit unit 43 (see FIGS. 2 and 3) fixed within the casing 41 for converting an alternating current signal into a direct current signal in a conventional manner, an AC input connected to the circuit unit 43 via a cable 42, and a DC output connected to the circuit unit 43 via wires 44. The casing 41 has first and second end walls 401, 402 that are perforated with holes 413 for air ventilation and dissipation of heat. The surrounding wall 33 is formed with an opening 331 proximate to the casing 41. The first end wall 401 is in contact with and is fixed to an outer side 332 of the surrounding wall 33 of the fan housing 3, and is formed with a first perforated area 411. The second end wall 402 is distal from the surrounding wall 33, is opposite to the first end wall 401, and is formed with a second perforated area 412. The first and second perforated areas 411, 412 are aligned with each other, and are in fluid communication with the opening 331.

The fan unit 5 includes a DC motor 51 mounted on the base plate 31, and a plurality of blades 53 extending outwardly from and driven by the DC motor 51 in a known manner.

The connecting unit 6 has a first connector 61 coupled to the DC motor 51 through wires 52 and adapted to be connected to a DC power source, and a second connector 62 provided on an end of the wires 44 to mate with the first connector 61 when necessary.

Hereinafter is a description of how the heat dissipating fan assembly of the present invention works. In areas where a DC power source is available, the first connector 61 is coupled directly to the DC power source to permit actuation of the fan unit 5 for dissipating the heat generated by a target component. In areas where an AC power source is available, the second connector 62 is coupled to the first connector 61, and the AC input is connected to the AC power source through the cable 42. Through the DC output of the converter 4, the DC motor 51 is actuated so as to rotate the fan blades 53, thereby producing air currents to dissipate the heat generated by a target component.

Since the converter 4 is fixed to the fan housing 3, during operation of the heat dissipating fan assembly of the present invention, a portion of air currents produced by the fan unit 5 flows through the opening 331 in the surrounding wall 33 and the first and second perforated areas 411, 412 in the casing 41 of the converter 4. As such, the heat dissipating fan assembly not only dissipates the heat generated by a heat generating component, but also dissipates the heat generated by elements inside the converter 4.

Figure 4:
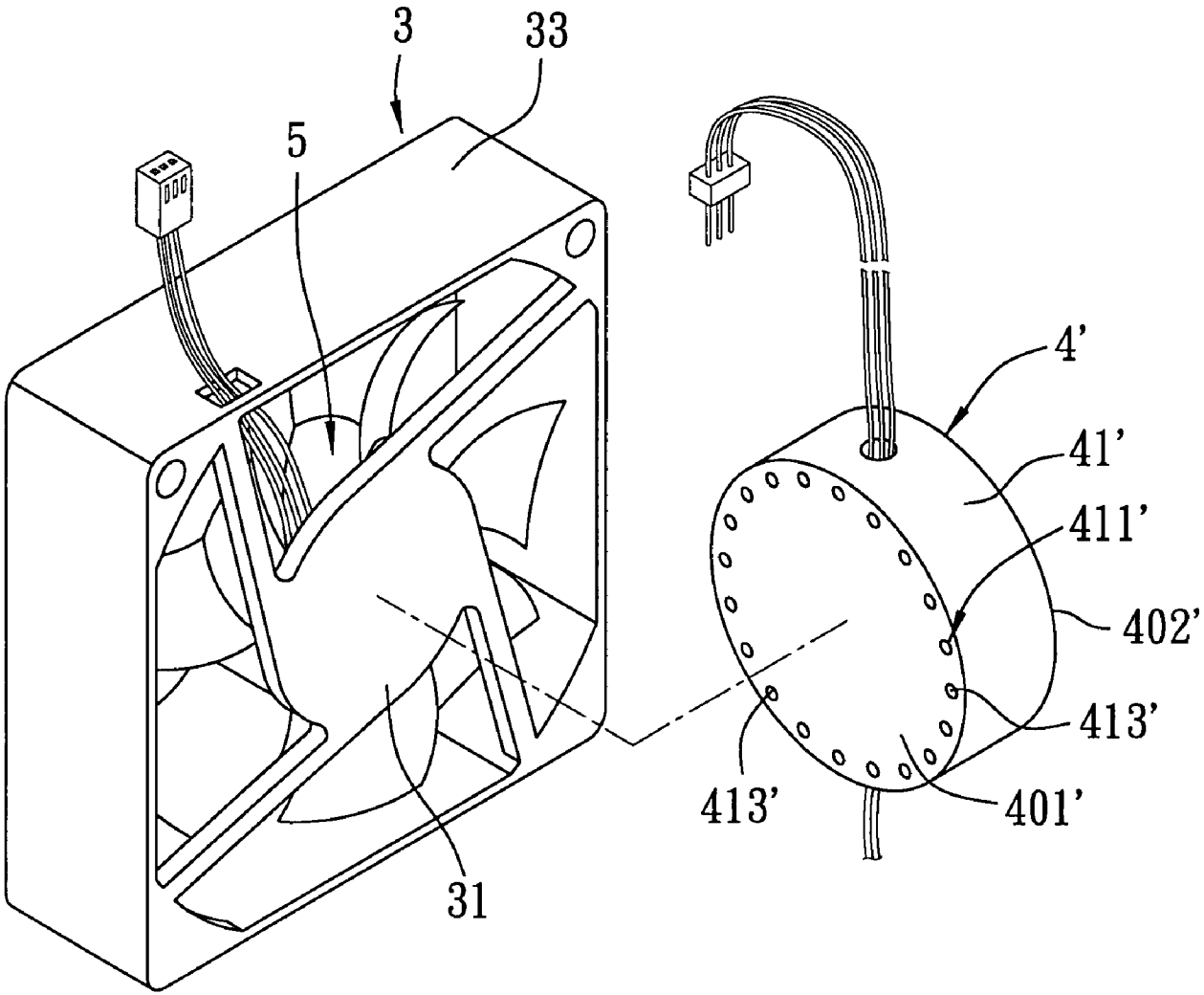
FIG. 4 is a partly exploded perspective view of the second preferred embodiment of a heat dissipating fan assembly according to the present invention.
Figure 5:
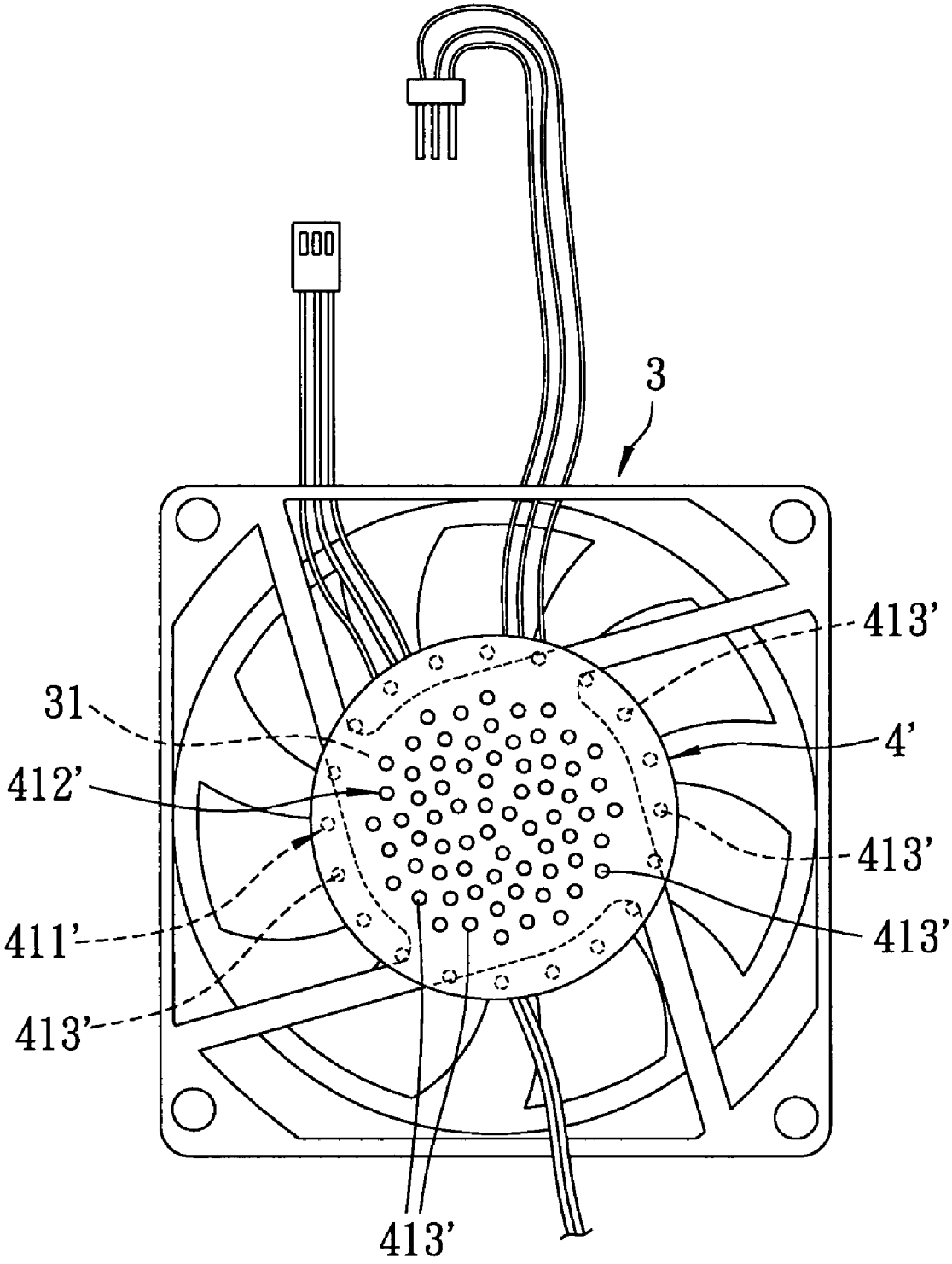
FIG. 5 is a schematic view of the second preferred embodiment in an assembled state.

Referring to FIGS. 4 and 5, the second preferred embodiment of the heat dissipating fan assembly according to the present invention is shown to be substantially similar to the first preferred embodiment. However, in this embodiment, the casing 41' of the converter 4' has a hollow circular shape, and is fixed to the base plate 31 of the fan housing 3. The casing 41' can be either adhered or screwed to an outer side of the base plate 31. The first end wall 401' of the casing 41' has a surface area larger than that of the base plate 31 so that the first end wall 401' has a portion in contact with the outer side of the base plate 31, and so that a remaining portion which extends around said portion is in fluid communication with an interior of the fan housing 3. The aforesaid remaining portion is formed with a first perforated area 411' with holes 413'. The second end wall 402' of the casing 41' is formed with a second perforated area 412' with holes 413' which are in fluid communication with the holes 413' in the first perforated area 411'. The surrounding wall 33 is not formed with the opening in this embodiment. Air currents produced by the fan unit 5 flow through the first and second perforated areas 411', 412', thereby dissipating the heat generated by the converter 4'.

From the aforementioned description of the present invention, it is apparent that through the fixing of the converter 4, 4' on the fan housing 3, the fan assembly of the present invention can be suitably used with a DC or an AC power source, and dispenses with the need to separately purchase and install a DC power supply or an AC-to-DC converter. Furthermore, during operation of the heat dissipating fan assembly of the present invention, the fan unit 5 dissipates not only the heat generated by a target component, but also dissipates the heat generated by the converter 4, 4'.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A heat dissipating fan assembly comprising:

a fan housing;

a fan unit including a DC motor mounted within said fan housing, and a plurality of blades extending outwardly from and driven by said motor;

a converter including a casing mounted on said fan housing, an AC-to-DC converter circuit unit provided within said casing, and an AC input and a DC output connected to said circuit unit; and a connecting unit having a first connector coupled to said DC motor, and a second connector coupled to said DC output and mateable with said first connector, wherein said fan housing includes a base plate, a plurality of spaced-apart branching brackets extending outwardly from said base plate, and a surrounding wall extending around an connected to said branching brackets.

2. The heat dissipating fan assembly as claimed in claim 1, wherein said casing has a first end wall in contact with said fan housing, and a second end wall distal from said fan housing and opposite to said first end wall, said first and second end walls being perforated for air ventilation and dissipation of heat.

3. The heat dissipating fan assembly as claimed in claim 2, wherein said casing is fixed to an outer side of said surrounding wall, said surrounding wall having an opening, said first end wall being in contact with said surrounding wall proximate to said opening and being formed with a first perforated area, said second end wall being formed with a second perforated area, said first and second perforated areas being in fluid communication with said opening.

4. The heat dissipating fan assembly as claimed in claim 2, wherein said casing is fixed to said base plate, said first end wall being in contact with an outer side of said base plate and being formed with a first perforated area, said second end wall being formed with a second perforated area which is in fluid communication with said first perforated area.

5. The heat dissipating fan assembly as claimed in claim 4, wherein said first end wall has a surface area larger than that of said base plate, said first end wall having a portion in contact with said outer side of said base plate and a remaining portion which extends around said portion and which is provided with said first perforated area, said first perforated area being fluidly communicated with an interior of said fan housing.

* * * * *